US006318770B1

(12) United States Patent
Molzer

(10) Patent No.: US 6,318,770 B1
(45) **Date of Patent: *Nov. 20, 2001**

(54) LATCH ASSEMBLY

(75) Inventor: Klaus Molzer, Jassjo (SE)

(73) Assignee: Austin Hardware, Inc., Spring Lake Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/580,858

(22) Filed: May 30, 2000

Related U.S. Application Data

(63) Continuation of application No. 09/042,233, filed on Mar. 13, 1998, now Pat. No. 6,068,308.

(51) Int. Cl.[7] ..... E05B 3/00

(52) U.S. Cl. ..... 292/336.3; 292/DIG. 62; 70/212

(58) Field of Search ..... 292/200, 202, 292/205, 207, 210, 226, 36.3, DIG. 30, DIG. 62; 70/208–210, 212, DIG. 63

(56) References Cited

U.S. PATENT DOCUMENTS

| | | | | |
|---|---|---|---|---|
| 2,219,626 | * | 10/1940 | Johnson | 74/535 |
| 2,949,328 | | 8/1960 | Kaiser | 292/207 |
| 3,096,114 | * | 7/1963 | Trammell | 292/336.3 |
| 3,159,994 | | 12/1964 | Schulz | 70/146 |
| 3,652,112 | * | 3/1972 | Panelli | 292/210 |
| 3,899,204 | * | 8/1975 | Ulrich | 292/336.3 |
| 4,103,945 | * | 8/1978 | Turman | 292/100 |
| 4,216,985 | * | 8/1980 | Sorensen | 292/336.3 |
| 4,583,775 | | 4/1986 | Bisbing | 292/64 |
| 4,763,935 | | 8/1988 | Bisbing | 292/66 |
| 5,184,853 | | 2/1993 | Whatley | 292/205 |
| 5,299,597 | | 4/1994 | Fort et al. | 137/385 |
| 5,390,517 | | 2/1995 | Yamada | 70/210 |
| 5,469,725 | | 11/1995 | Yamada | 70/208 |
| 5,566,992 | * | 10/1996 | Andersen | 292/241 |
| 5,634,357 | | 6/1997 | Nutter | 70/210 |
| 5,664,448 | | 9/1997 | Swan | 70/203 |

* cited by examiner

*Primary Examiner*—Gary Estremsky
(74) *Attorney, Agent, or Firm*—Vidas, Arrett & Steinkraus

(57) ABSTRACT

A latching assembly that requires three distinct operations must be performed with two hands to allow the handle of the latch assembly to be rotated to unlock a cabinet door or the like. The assembly provides substantial flexibilities in installation. A base portion is secured to a door and receives a handle portion with a shaft attached, the shaft extending through the sleeve. Cooperative rotation restriction portions on the handle and on the base portion restrict the motion of the handle to a limited rotation range. Said limited rotation range may be altered by moving a key guide in one of the cooperative rotation restriction portions. A first release mechanism comprising a trigger portion which extends from the handle and a detent which engages a detent opening in the base portion requires depression of the trigger portion before rotation of the handle to an unlatched position. The detent mechanism is within the handle and a cap contained and encloses in the detent mechanism. The cap portion has a bore which receives a second release mechanism which has a shaft portion that may be exteriorly manipulated to move an obstructing member into and out of an obstructing relation with the detent. Thus, the second release mechanism must be manipulated to allow release of the trigger portion which must then be depressed to allow rotation of the handle. The cap portion is secured in the handle by screws or other threaded members extending from the handle base portion interface into the cap.

7 Claims, 4 Drawing Sheets

152
236
214
232
264
154
39
152
70
154
36
88

98
88
194

142
96
85
85
46
70
70
30
192
94
264
262
28
256
76

LATCH ASSEMBLY

CROSS-REFERENCE TO RELATED APPLICATIONS

This application is a continuation application of U.S. application Ser. No. 09/042,233 Mar. 13, 1998 now U.S. Pat. No. 6,068,308, the entire contents of which are hereby incorporated by reference.

STATEMENT REGARDING FEDERALLY SPONSORED RESEARCH

Not Applicable

BACKGROUND OF THE INVENTION

Latch assemblies with handles are known which are lockable by utilization of an internal lock cylinder which prevents the handle from rotating. Typically these latch assemblies can be locked and unlocked and remain in the unlocked position whereby the handle and door attached thereto may be opened with one hand. Standards adopted in the telecommunications industries require that two hands be utilized to operate certain cabinet latching assemblies. There has been minimal development of effective and convenient latching assemblies which have this feature. Additional locking features to accommodate a paddle lock is also desirable as the primary locking means or a secondary locking means on such latching assemblies. Prior art latch assemblies, particularly locking latch assemblies, normally lack flexibility in being adaptable for varying applications, for example a left or right hand door.

BRIEF DESCRIPTION OF THE INVENTION

The present invention provides a latching assembly that requires three distinct operations which must be performed with two hands to allow the handle of the latch assembly to be rotated to unlock a cabinet door or the like. Moreover, the design allows substantial flexibilities in installation.

A base portion is secured to a door and receives a handle portion with a shaft attached, the shaft extending through the sleeve. Cooperative rotation restriction portions on the handle and on the base portion restrict the motion of the handle to a limited rotation range. Said limited rotation range may be altered by moving a key guide in one of the cooperative rotation restriction portions. A first release mechanism comprising a trigger portion which extends from the handle and a detent which engages an opening in the support portion requires depression of the trigger portion before rotation of the handle to an unlatched position. The detent mechanism is within the handle and a cap contains and encloses in the detent mechanism. The cap portion has a bore which receives a second release mechanism which has a shaft portion that may be exteriorly manipulated to move an obstructive member into and out of an obstructing relation with the detent. Thus, the second release mechanism must be manipulated to allow release of the trigger portion which must then be depressed to allow rotation of the handle. The cap portion is secured in the handle by screws or other threaded members extending from the handle base portion interface into the cap.

In an alternative embodiment, the first release mechanism comprises a trigger portion which pivots with respect to the handle, and the second release mechanism slides linearly with respect to the handle.

The trigger portion of the first release mechanism is pivotally connected to the handle of the latch mechanism and includes a first interference portion or detent which extends forwardly into a first slot of the base to prevent rotational movement of the handle relative to the base.

The slide portion of the second release mechanism includes a second interference portion or detent, and is operatively connected to the obstructing member of the axially rotatable second release mechanism so that upon rotational movement of the second release mechanism, the second interference portion is brought into and out of engagement with the first slot in the base. Second interference portion also prevents rotational movement of the handle relative to the base.

The trigger and slide portions are arranged so that the first and second interference portions are juxtaposed within the first slot in the base so that the second interference portion prevents the first interference portion from being disengaged from the first slot in the base. When the second release mechanism disengages the second interference portion from the first slot in the base, the first interference portion of the first release mechanism may be pivoted out of engagement with the first slot of the base, thus enabling the handle to be rotated to engage or disengage the latch member from the latch receiver.

A feature and advantage of the invention is that a finger operated slide member must be depressed into the handle before rotation of the handle.

A feature and advantage of the invention is that a release mechanism positioned in the head of the handle must rotate to allow the handle to be rotated.

A further feature and advantage of a preferred embodiment is that the release shaft portion must be rotated before the finger operated slide member may be depressed into the handle.

A further feature and advantage of the invention is that the handle when rotated to the unlatched seconded position is retained in place by the slide member engaging a second detent recess.

A further feature and advantage of the invention is that the handle is easily convertible from a clockwise unlatching rotation to a counterclockwise unlatching rotation by simple internal alteration. The same latching assembly can thus be used for either right or left hand opening doors.

A feature and advantage of the invention is that with the same handle, base portion, and shaft, a blank plug may be inserted into the head of the handle eliminating the release shaft portion such that the latching assembly may be operated with one hand.

A feature and advantage of the invention is that the release shaft portion may utilize a key operated insert, either radial pin-tumblers or normal flat key cylinders.

An additional advantage and feature of the invention is that three separate actions are required to unlatch the latching assembly and only a single action, rotation of the handle is necessary for latching the latching mechanism.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
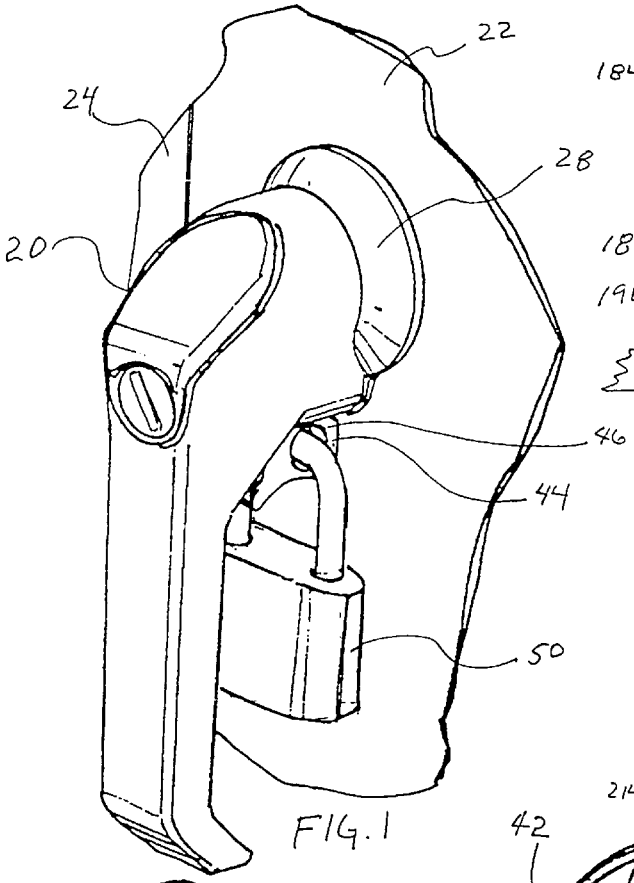
FIG. 1 is a perspective view of the latch assembly in place on a door with a padlock.
Figure 2:
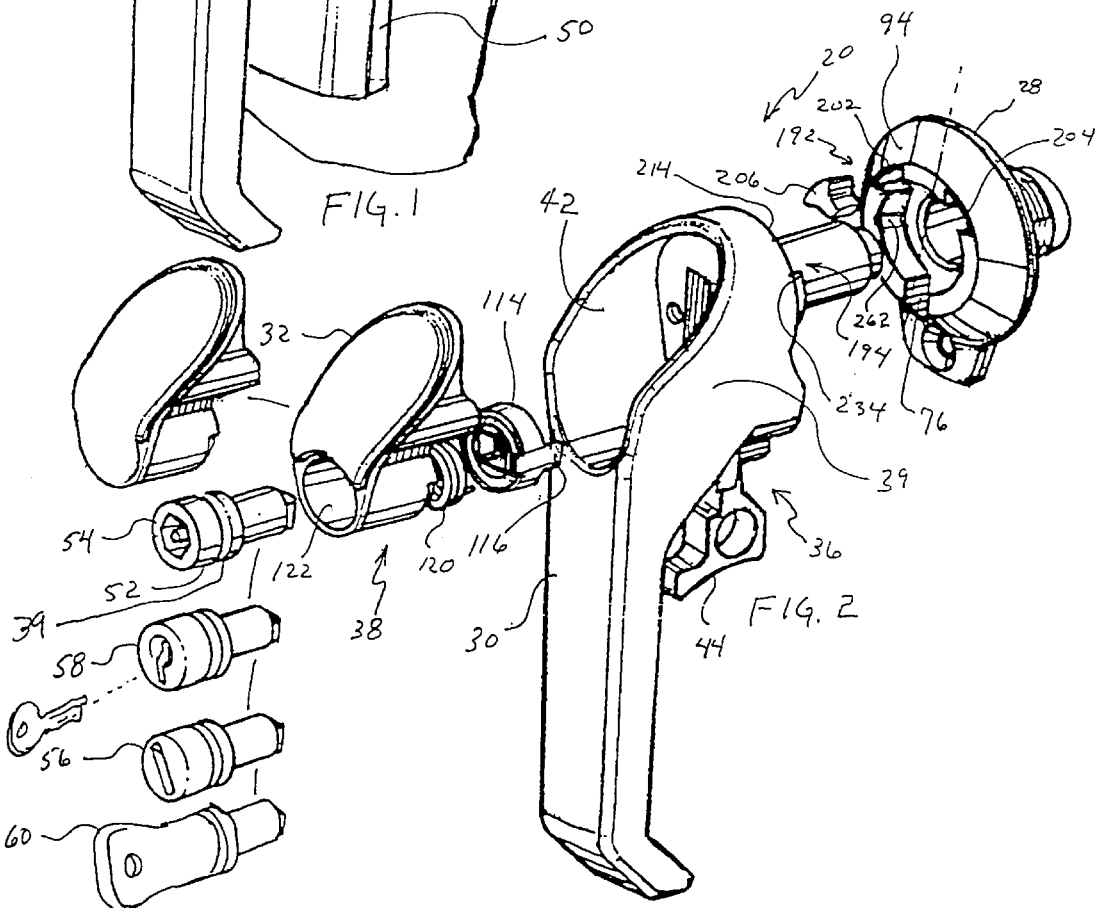
FIG. 2 is a exploded perspective view of the latch assembly showing alternative shaft portion ends.

Referring to FIGS. 1 and 2, the latching mechanism is shown in position on a door and in an exploded view. The latching mechanism is generally designated with the numeral 20 and is tended to be secured to a door 22 in a door frame 24. The latching mechanism is principally comprised of a base portion 28, a handle 30, a plug or cap 32, a first release mechanism 36 and a second release mechanism 38. The handle as a head portion 31 with an open interior configured as a cap or plug receiving regions 42.

Figure 4:
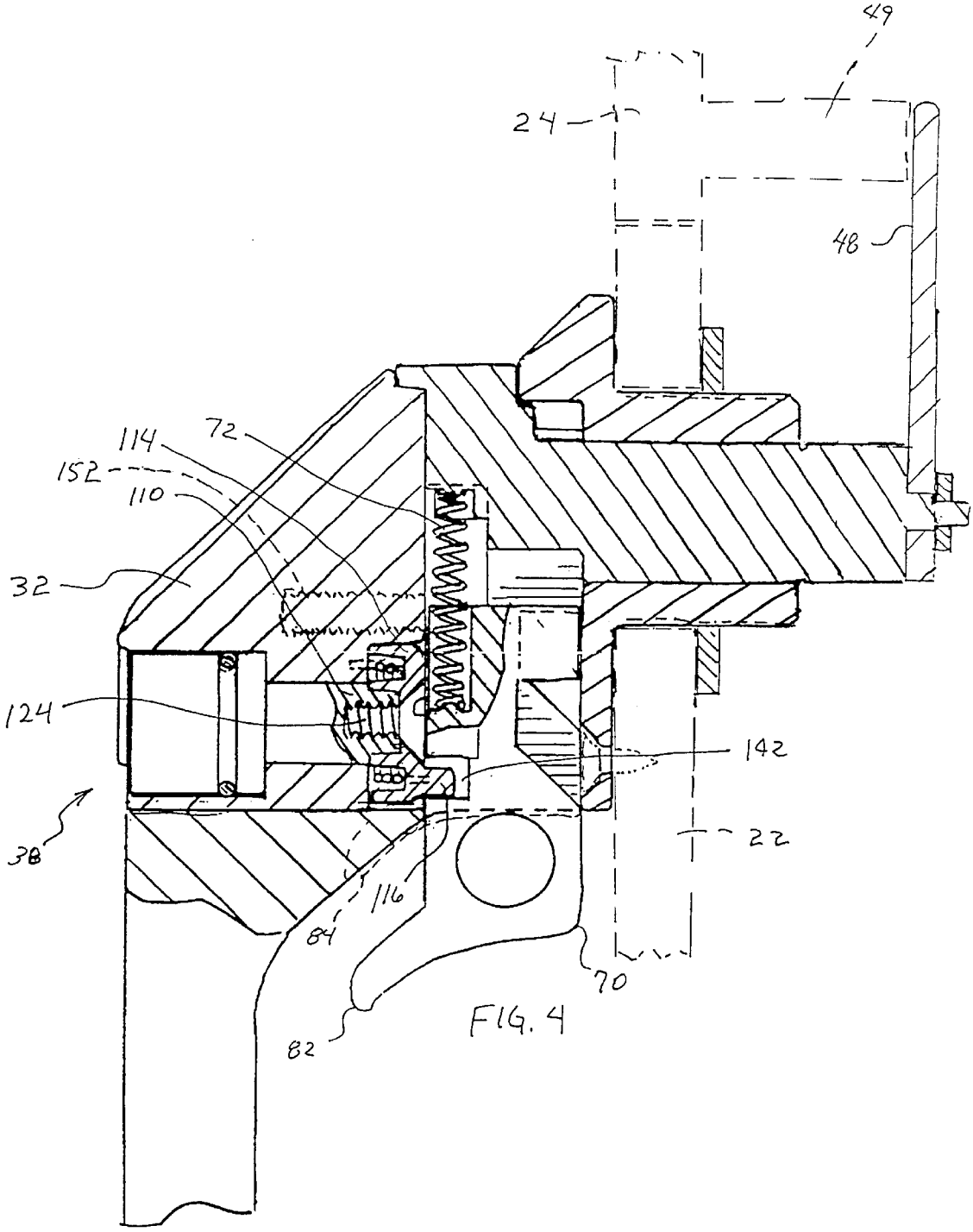
FIG. 4 is a cross-sectional view through the device.

The first release mechanism is a detent mechanism in the preferred embodiment and has a protruding portion configured as a trigger portion 44 which comprises a loop 46 sized for receiving a padlock 50. The second release mechanism 38 has a first end 31 which may be a tool receptacle 54, 56, or a key cylinder 58 or a manually manipulatable member 60 and a second end that interferes or obstructs the operation of the detent mechanism. Thus, the rotation of the handle and the actuation of the latch member 48 involves sequential actuation of the second release mechanism by rotation of the first end and depression of the trigger portion 44 at which point the handle 30 may be partially rotated to release an internal latch member 48 from a latch receiver 49 as shown in FIG. 4. The shaft may have any conventional configuration with the latching member attached by any suitable means.

Figures 3A, 3B, 3C, 8:
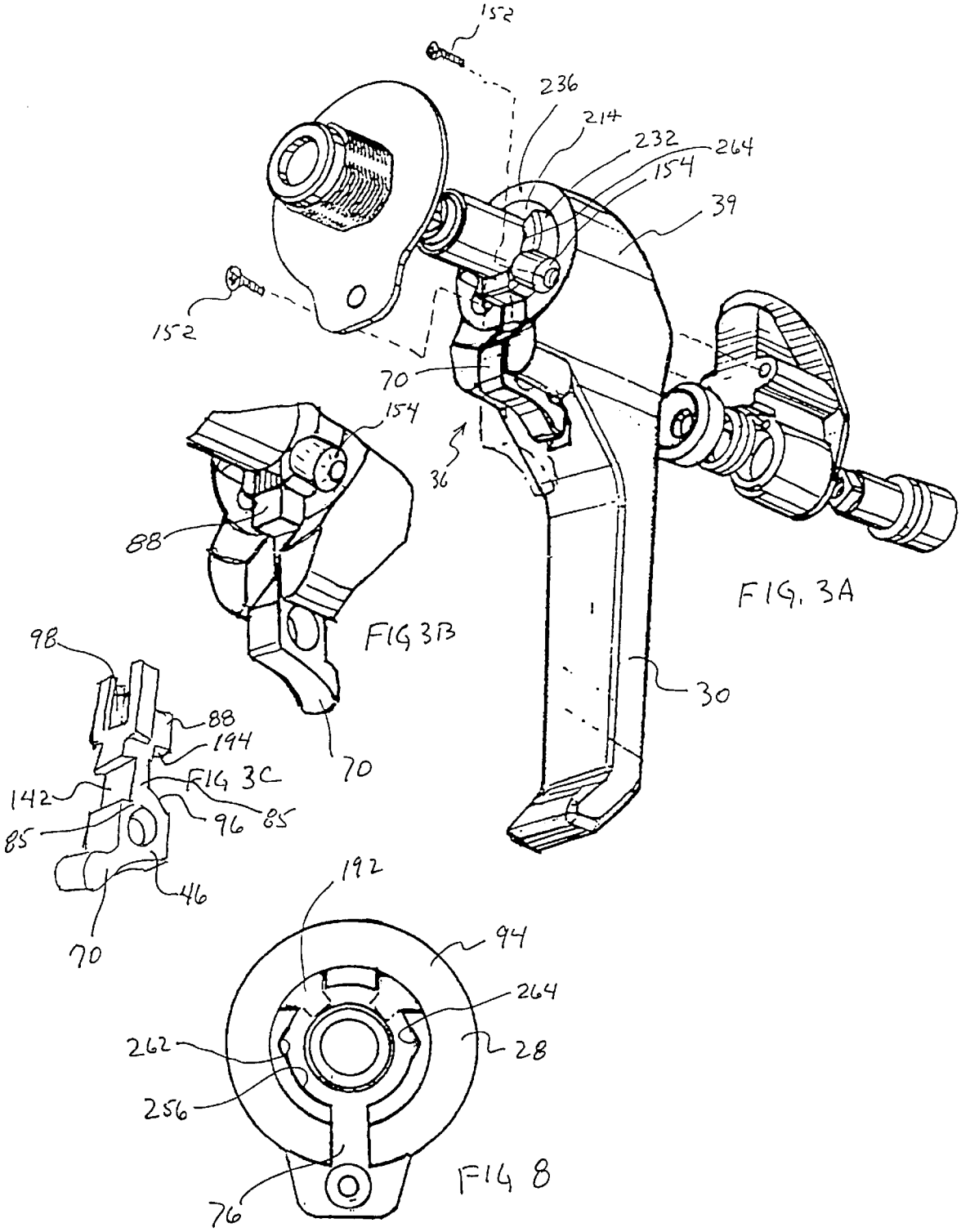
FIG. 3A is an exploded perspective view of the invention.
FIG. 3B is a portion of FIG. 3A with the trigger portion in a different position.
FIG. 3C is a detailed perspective view of the slide member including the trigger portion.
FIG. 8 is a front elevational view of the body portion with a key guide in place.

Details of the first release mechanism are as follows. Referring to FIGS. 3A, 3B, 3C, 4, 5, 6, and 7, the components of the first release mechanism 36 are the finger operated slide member 70 which is shown in isolation in FIG. 3C, the spring 72, which provides a downward bias to the slide member 70, the base portion 28, specifically the first slot 76, the handle 30, specifically the second slot 80. Due to this bias, the slide member 70 is normally in the extended position as shown in FIGS. 3B and 4 in the solid lines and is indicated with the numeral 82. The depressed position as shown in FIG. 3A in slotted lines and in FIG. 4 in dashed lines has been designated with the numeral 84.

Note that the slide member has regions of a reduced cross sectional portion 85 where the protruding portion extends from the head of the handle whereby when the protruding portion receives a sharp impact such as from someone trying to remove the padlock, the slide member tends to fracture at said reduced cross sectional portion inhibiting further movement of the slide member from the extended position to the depressed position.

The slide member 70 has an interference portion or detent 88 which in the extended position is positioned in the slot 76 preventing rotation of the handle 30 with respect to the base portion 28. Depression of the trigger portion 44 extends the detent 88 upwardly out of the way of the frustoconically shaped collar portion 94 of the base portion 28. In such a position the recess 96 on the slide member which is conformed to shape to said frustoconical portion of the base portion rotates around on said frustoconical portion as the handle is rotated. The spring is contained in a spring containment region 98.

The second release mechanism 38 is best shown in FIGS. 2, 3A, 4, and 6. The mechanism 38 has a shaft portion 110 which is comprised of the rotatable portions such as the first end 52 to the opposite end 114 which is configured as a cylindrical member with an obstructing portion 116.

A torsion spring 120 is engaged with the cylindrical member 114 and the cap 32 is constrained by and fits in the bore 122. A screw 124 secures the cylindrical member 114 to the first end of the shaft portion. The obstructing portion 116 rotates with the shaft portion between an obstructing position as indicated with the numeral 130 and a non-obstructing position as indicated with the numeral 132. The handle has a recess 134 in which the obstructing member travels and has a first stop portion 136 and a second stop portion 138 both of which in the preferred embodiment are integral with the handle 30. The obstructing portion 116 in the obstructing position engages with the slot 142 of the slide member 70. The second release mechanism is secured within the head of the handle portion 30 by securing the cap 32 to the handle head by way of screws 152 in the screw recesses 154 as best shown in FIG. 3A.

Figure 9:
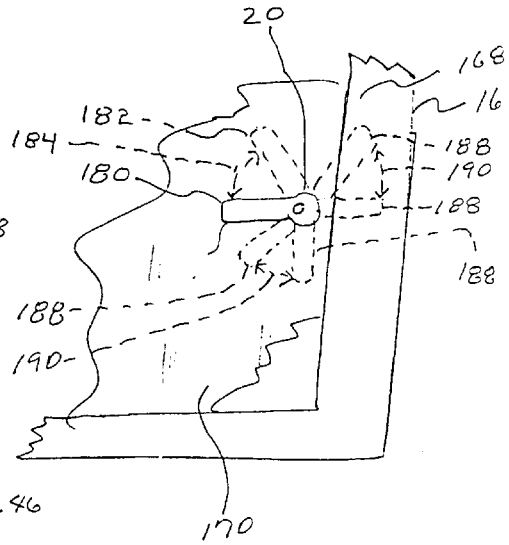
FIG. 9 is a schematic view showing different rotational positions of the handle and different range of rotations.

Referring to FIG. 9 the use of latching mechanism 20 on a cabinet 166 is illustrated. The cabinet has a door frame 168 and a door 170. Several different positions of the handle are shown with respective range of rotations. The handle 30 shown in the first position as indicated by the numeral 180 rotates from the first position to the upright position as indicated by the numeral 182 which is designated the second position and is the unlatched position for the latch assembly. The first position and second position define a range of rotation as indicated by the arrows designated with the numeral 184. Alternative placements of the handle are possible as indicated by the handles drawn in phantom in dashed lines and designated with the numeral 188 which each have their respective range of rotations 190. The different positioning of the handle are possible with the same latch assembly by way of altering the positioning of internal components and by rotating the base portion on the door.

Figure 7:
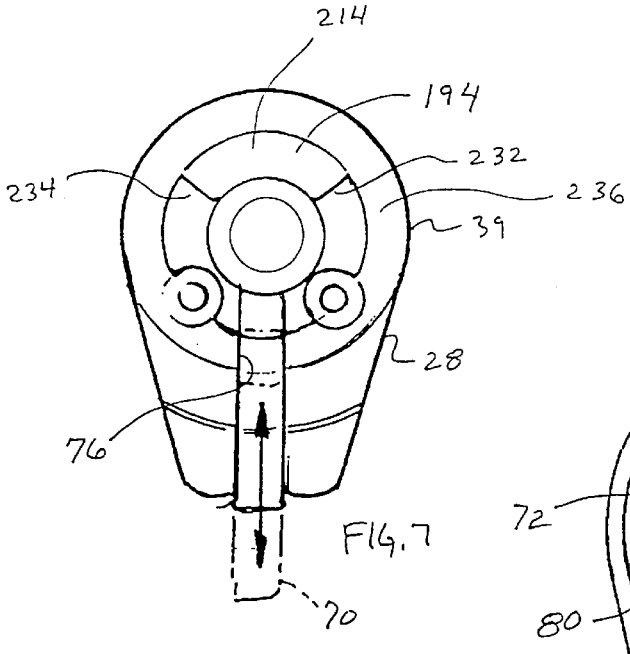
FIG. 7 is a front elevational view of the handle and shaft without the base portion and with member in place.
Figure 5:
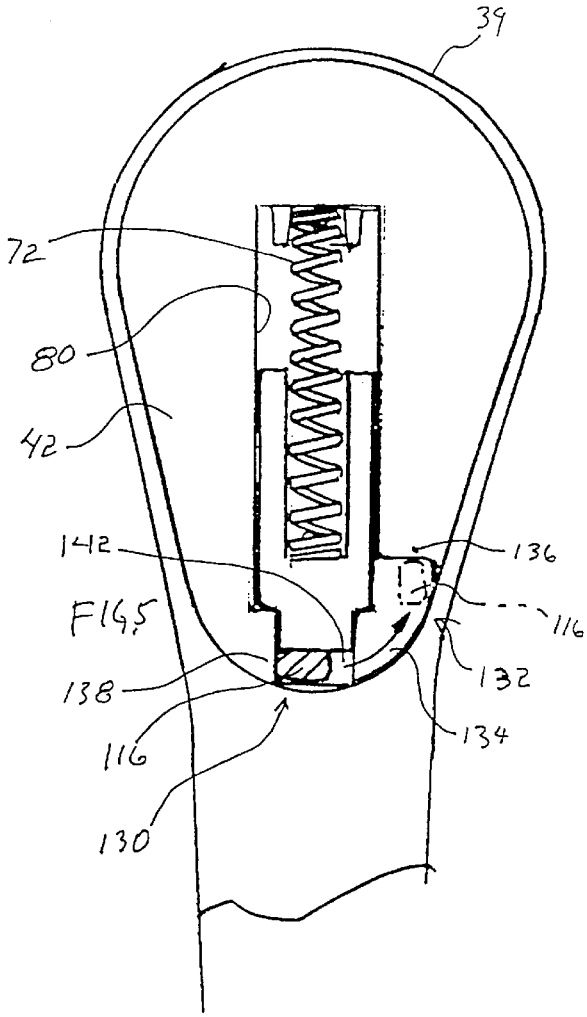
FIG. 5 is an elevational view of the end of the handle with the cap end and shaft portion removed except for the obstructing portion.
Figure 6:
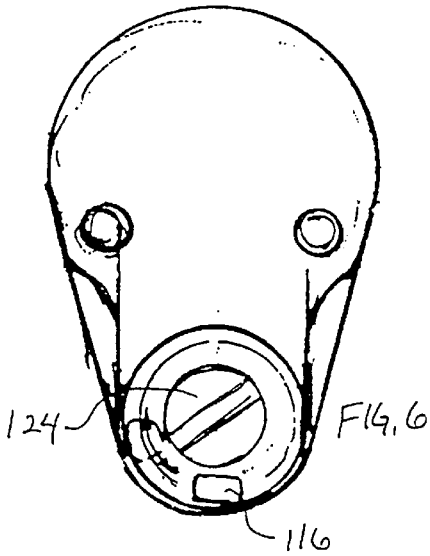
FIG. 6 is an elevational view of the inside of the cap with the shaft portion in place illustrating the obstructing portion.

Referring to FIGS. 2, 7, and 8, the base portion 28 and the handle each have cooperative rotation restriction portions 192, 194. The cooperative rotation restriction portion 192 on the base portion 28 has alternate seeding recesses 202, 204 for the guide key 206. The other cooperative rotation restriction portion 194 as best shown on FIG. 7 and as also shown in FIG. 3A, has an open area 214 in which the guide key 206 is allowed to rotate. The open area and the range of rotation of the guide key and thus the handle is defined by the opposing stops 232, 234 which are both integral with the handle in the preferred embodiment. The guide key 206 is shown as a separate component but it also is understood that said guide key can be integral with the base portion. Additionally the cooperating rotation restriction portions can be reversed as to the base portion and the handle. That is the guide key seating recesses 202, 204 could be on the front face 236 of the handle head portion 39 and the stops 232, 234 could be on the body portion. Additionally the stop portions could also be separate removable components similar to the guide key 206 to allow alteration or expansion of the range of rotation.

Referring to FIG. 8, note that the frustroconical portion of the collar portion 94 has an interior surface 256 which is generally cylindrical in shape with the exception of the seating recesses 202, 204 and also to secondary detent recesses 262, 264 as the handle is rotated through its range of rotation. The slide member 70 is in the depressed or retracted position, although it is continually biased outward. Unless the trigger portion is being manually held in the depressed position, this bias outward causes the surface 196 of the detent 88 to continually engage said inside surface 256. At the secondary detent recesses 262, 264, the handle will be held in the specific position correlating to these recesses. For example, the handle as shown in FIG. 1, may be raised to an upright portion which would correspond to the detent 88 positioned in one of said recesses. This will operate to secure the handle in the more horizontal position and prevent the handle from falling to the down vertical position and inadvertently locking the cabinet. Note that the two secondary recesses as shown are applicable only in the convertible latching mechanism in which the guide key or similar means provides reconfiguration of the assembly.

In addition to being directed to the embodiments described above and claimed below, the present invention is further directed to embodiments having different combinations of the features described above and claimed below. As such, the invention is also directed to other embodiments having any other possible combination of the dependent features claimed below.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A latch assembly for attachment to a door in a door frame, the latch assembly comprising:

a) a base portion for attachment to the door, the base portion for extending through the door;

b) a shaft extending through the base portion for latching with respect to the door frame;

c) a handle fixed to the shaft whereby the handle and shaft are at least partially rotatable with respect to the base between a first position and a second position, the handle having a head portion connecting to the shaft, a grasping portion extending from the head portion, the head portion configured for engagement with the base portion;

d) a first release mechanism positioned in the head portion and having a protruding portion extending from said head portion, the first release mechanism having a release position and an interference position, the first release mechanism configured such that when in the interference position the first release mechanism interferes with the rotation of the handle and shaft with respect to the base portion, the first release mechanism further configured such that when in the release position, the handle and shaft may be rotated between the first position and the second position; and e) a second release mechanism positioned in the head portion, the second release mechanism having an engaged position and an unengaged position, the second release mechanism configured such that when in the engaged position the second release mechanism interferes with the rotation of the handle and shaft with respect to the base portion, the second release mechanism further configured such that when in the unengaged position the handle and shaft may be rotated between the first position and the second position.

2. The latch assembly of claim 1, wherein the protruding portion comprises a loop for receiving a padlock.

3. The latch assembly of claim 2, wherein the first release mechanism further comprises a slide member, the slide member having a reduced cross sectional portion where the protruding portion extends from the head of the handle whereby when the protruding portion receives an impact the slide member tends to fracture at said reduced cross sectional portion inhibiting movement of the slide member from the extended position to the depressed position.

4. The latch assembly of claim 2 wherein the handle and shaft rotation is preceded by both the second release mechanism being placed in the unengaged position, followed by the first release mechanism being placed in the release position.

5. A latch assembly for attachment to a door in a door frame, the latch assembly comprising:

a) a base portion attachable to a door, the base having an aperture and a radial slot extending from the aperture;

b) a handle, the handle having a shaft attached thereto, the shaft rotatingly received by the aperture in the base; the handle having a first release mechanism, the first release mechanism having a first interference portion biased into engagement with the radial slot of the base; the handle having a second release mechanism, the second release mechanism having a second interference portion biased into engagement with the radial slot of the base;

wherein, the first and second interference portions prevent relative rotation between the handle and the base when the first and second interference portions engage the radial slot; and, wherein the handle may be rotated relative to the base when the first and second interference portions are disengaged from slot.

6. The latch assembly of claim 5, wherein disengagement of the first interference portion from the radial slot is dependent upon prior disengagement of the second release mechanism from the radial slot.

7. The latch assembly of claim 5, wherein the base further comprises an index pin, the index pin projecting into the surface of a door to prevent rotation of the base relative to a door.

* * * * *